United States Patent [19]

Powell

[11] 4,380,975

[45] Apr. 26, 1983

[54] COLD STARTING SYSTEM FOR ALCOHOL FUELED ENGINE

[75] Inventor: Thomas M. Powell, Rochester, Mich.

[73] Assignee: General Motors Corporation, Detroit, Mich.

[21] Appl. No.: 251,487

[22] Filed: Apr. 6, 1981

[51] Int. Cl.[3] ..... F02N 17/00

[52] U.S. Cl. ..... 123/179 H; 123/180 AC; 123/551; 123/576; 123/1 A

[58] Field of Search ..... 123/1 A, 179 H, 180 AC, 123/550, 551, 575–578

[56] References Cited

U.S. PATENT DOCUMENTS

| | | | |
|---|---|---|---|
| 1,726,455 | 8/1929 | Rector | 123/550 |
| 2,069,689 | 2/1937 | Trca | 123/550 |
| 2,192,389 | 3/1940 | Trca | 123/550 |
| 3,556,065 | 1/1971 | Jordan | 123/179 G |
| 3,851,633 | 12/1974 | Shih | 123/179 G |

*Primary Examiner*—Charles J. Myhre
*Assistant Examiner*—E. Rollins Cross
*Attorney, Agent, or Firm*—C. K. Veenstra

[57] ABSTRACT

To restart an alcohol fueled engine at low temperatures, a quantity of liquid ethanol is supplied to a vaporizing chamber before the engine is stopped. When restarting the engine, some of the alcohol in the vaporizing chamber is delivered to an igniter, and the hot gases resulting from the burning alcohol are conducted past the vaporizing chamber to evaporate the liquid alcohol remaining in the vaporizing chamber. The alcohol vapor thus generated is conducted to the engine induction system to start the engine.

2 Claims, 2 Drawing Figures

COLD STARTING SYSTEM FOR ALCOHOL FUELED ENGINE

TECHNICAL FIELD

This invention relates to systems for starting alcohol fueled engines at low temperatures.

BACKGROUND

Engines fueled with ethanol have proven difficult to start at temperatures less than about 15° C. because at low temperatures ethanol does not produce sufficient vapor to support combustion. The current practice in starting ethanol fueled engines at low temperatures is to discharge a quantity of gasoline into the engine induction system; a fraction of the gasoline evaporates sufficiently to start the engine, and the resulting increase in engine temperature is sufficient to thereafter sustain operation on ethanol.

SUMMARY OF THE INVENTION

This invention provides a system for starting an alcohol fueled engine at low temperatures without adding a second fuel such as gasoline.

In this system, a vaporizing chamber is charged with a quantity of liquid alcohol before the engine is stopped. Then, when subsequently starting the engine at low temperatures, a stream of liquid alcohol is drawn from the vaporizing chamber and ignited in a burner chamber. The hot gases in the burner chamber are conducted past the vaporizing chamber to vaporize the liquid alcohol, and the alcohol vapor which is generated is conducted to the engine induction system to thereby provide sufficient alcohol vapor to start the engine.

The details as well as other features and advantages of this invention are set forth in the remainder of the specification and are shown in the accompanying drawings.

BEST MODE FOR CARRYING OUT THE INVENTION

Figure 1:
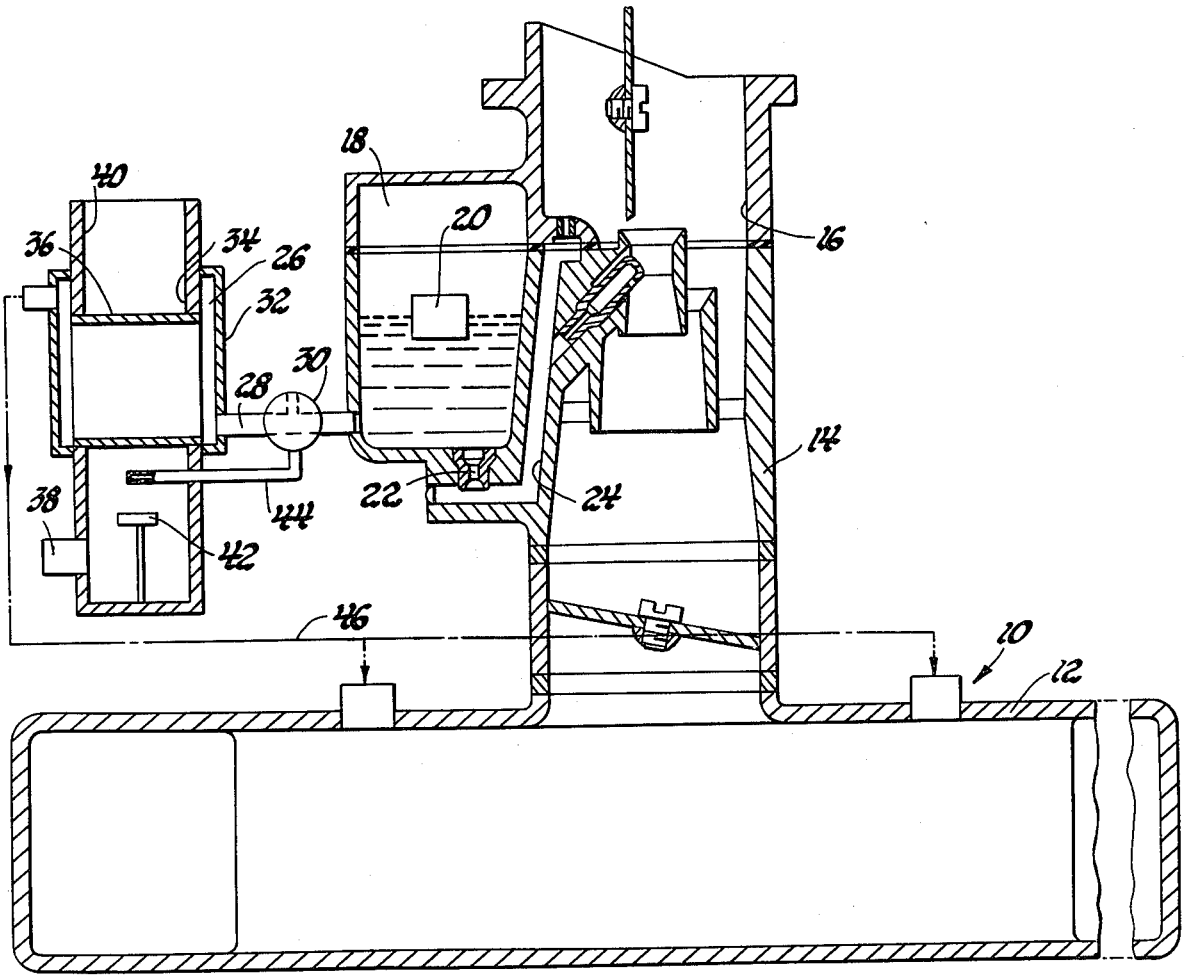
FIG. 1 is a schematic view of an engine induction system with a cold starting system according to this invention.

Referring first to FIG. 1, an engine 10 has an induction system including an intake manifold 12 and a carburetor 14 which together define an induction passage 16 for air flow to the engine. Carburetor 14 includes a fuel bowl 18 containing liquid ethanol maintained at a constant level by a float mechanism indicated at 20; fuel bowl 18 discharges liquid ethanol in a conventional manner through a metering orifice 22 and a fuel passage 24 leading to induction passage 16 where the liquid ethanol is mixed with the air flow to provide an air-fuel mixture for combustion in the engine.

An ethanol vaporizing chamber 26 has an inlet 28 connected through a valve 30 to carburetor fuel bowl 18. With valve 30 in its normally open position, liquid ethanol is supplied from fuel bowl 18 to vaporizing chamber 26 and float mechanism 20 is effective to maintain a constant level of liquid ethanol in vaporizing chamber 26.

Vaporizing chamber 26 may have a variety of configurations and is here shown as formed by a shell 32 surrounding a tubular burner chamber 34 and including tubes 36 passing through burner chamber 34.

Burner chamber 34 has a lower inlet 38 for combustion air and an upper exhaust outlet 40 and contains an igniter 42. A restricted fuel inlet 44, controlled by valve 30, is adapted to direct a stream of liquid ethanol from vaporizing chamber 26 to igniter 42, thereby burning the stream of ethanol to create a supply of hot gases in burner chamber 34. As the hot gases flow upwardly toward exhaust outlet 40, they are conducted past and in heat exchange relation with vaporizing chamber 26. The hot gases vaporize the liquid ethanol remaining in vaporizing chamber 26, and a conduit 46 conducts the ethanol vapor from chamber 26 to intake manifold 12.

Figure 2:
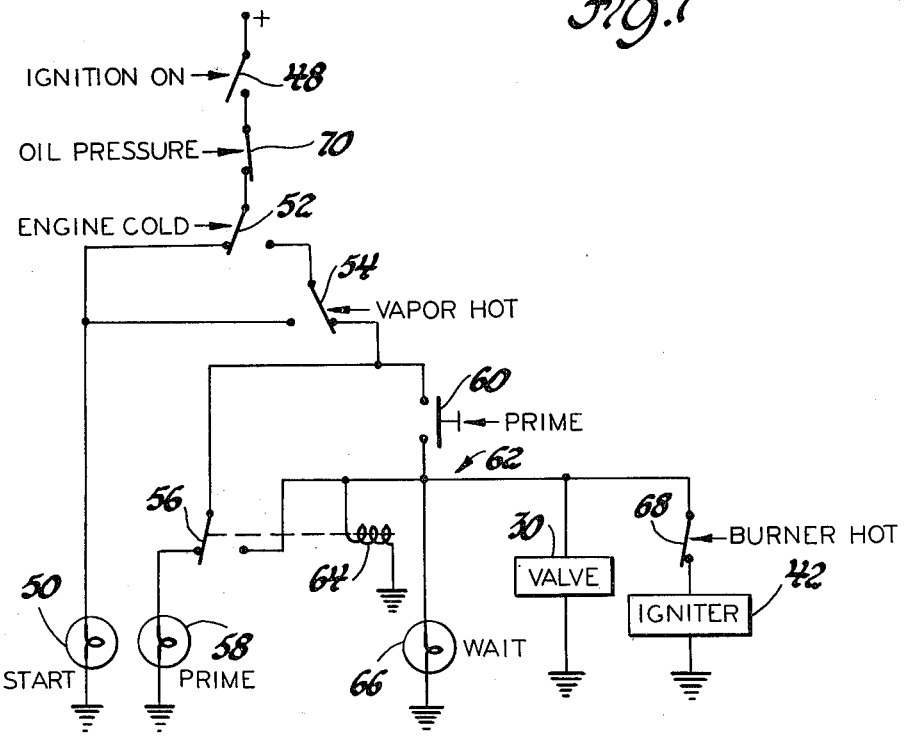
FIG. 2 schematically illustrates a control circuit which may be used with this invention.

The operation of this cold starting system may be understood by reference to FIG. 2. When it is desired to start engine 10, an ignition switch 48 is closed. If the engine is at a temperature suitable for starting without special provision, a light 50 informs the operator that engine 10 may be started immediately. However, if the engine is at a temperature which requires special starting provisions, a switch 52 is moved rightwardly and makes a circuit through switches 54 and 56, and a light 58 thereupon instructs the operator to prime the engine. When the operator closes a prime switch 60, a parallel network 62 including a holding relay 64 is energized to move switch 56 rightwardly, thereby extinguishing prime light 58 while closing another circuit to network 62. Within network 62, another lamp 66 instructs the operator to "wait", igniter 42 is energized, and valve 30 is operated to close the flow path from carburetor fuel bowl 18 to vaporizing chamber 26 and to open the flow path from vaporizing chamber 26 to burner chamber 34.

The stream of ethanol delivered from vaporizing chamber 26 to burner chamber 34 through inlet 44 is ignited, and the resulting supply of hot gases evaporate the liquid ethanol in chamber 26. A switch 68 may be opened to deenergize igniter 42 when it senses that the temperature in burner chamber 34 is sufficient to sustain combustion of the stream of ethanol delivered through inlet 44. Thereafter, switch 54 may be moved leftwardly when the temperature in vaporizing chamber 26 indicates that sufficient ethanol vapor has been generated to start the engine; leftward movement of switch 54 deenergizes network 62 and causes light 50 to inform the operator that engine 10 may be started.

As network 62 is deenergized, valve 30 closes inlet 44 and opens inlet 28 so vaporizing chamber 26 may be recharged with ethanol from carburetor fuel bowl 18.

Once the engine has started, the resulting increase in engine oil pressure moves a switch 70 rightwardly to deenergize the cold starting circuit.

Igniter 42 may be of any appropriate construction, a diesel engine glow plug providing one well-known example.

It will be appreciated that this invention may be employed in a variety of other embodiments within the scope of the following claims.

The embodiments of the invention in which an exclusive property or privilege is claimed are defined as follows:

1. A cold starting system for an engine having means for mixing liquid alcohol with air to form an air-fuel mixture and having an induction manifold for conducting said mixture to the engine, said system comprising:

an alcohol heating chamber, an alcohol burner chamber in heat exchange relation with said heating chamber, an igniter in said burner chamber, means effective prior to stopping the engine for supplying a quantity of liquid alcohol to said heating chamber, means effective prior to starting the engine at engine temperature below a selected value for energizing said igniter and for delivering a stream of liquid alcohol from said heating chamber to said igniter, thereby burning the stream of alcohol to create a supply of hot gases in said burner chamber effective to vaporize liquid alcohol remaining in said heating chamber, and means for conducting alcohol vapor from said heating chamber to said induction manifold to thereby provide sufficient alcohol vapor to start the engine.

2. A cold starting system for an engine having an induction passage for air and fuel flow to the engine, a carburetor fuel bowl containing a quantity of liquid ethanol, and a carburetor fuel passage extending from said fuel bowl to said induction passage for mixing liquid ethanol with air to form an air-fuel mixture in said induction passage, said system comprising:

an ethanol heating chamber having an inlet connected to said fuel bowl, said inlet being open prior to starting the engine to permit said fuel bowl to supply a quantity of liquid ethanol to said heating chamber, an ethanol burner chamber in heat exchange relation with said heating chamber, said burner chamber having an igniter and further having an inlet connected to said heating chamber, means effective prior to starting the engine at engine temperatures below a selected value for energizing said igniter and for opening said burner chamber inlet to direct a stream of liquid ethanol from said heating chamber to said igniter, thereby burning the stream of ethanol to create a supply of hot gases in said burner chamber effective to vaporize liquid ethanol remaining in said heating chamber, means responsive to temperature in said burner chamber for deenergizing said igniter when burner chamber temperature is sufficient to sustain combustion of the stream of ethanol, means responsive to temperature in said heating chamber for closing said burner chamber inlet when heating chamber temperature indicates adequate vaporization of liquid ethanol, and means for conducting ethanol vapor from said heating chamber to said induction passage to thereby provide sufficient ethanol vapor to start the engine.

* * * * *